US010668469B2

(12) United States Patent
Wu et al.

(10) Patent No.: US 10,668,469 B2
(45) Date of Patent: Jun. 2, 2020

(54) BIOLOGICAL SORTING APPARATUS AND METHOD THEREOF

(71) Applicant: TECHTRON TECHNOLOGY CO., LTD., New Taipei (TW)

(72) Inventors: Hung-Wei Wu, Tainan (TW); Cheng-Yuan Hung, Kaohsiung (TW); Chang-Sin Ye, Tainan (TW)

(73) Assignee: TECHTRON TECHNOLOGY CO., LTD., Taipei (TW)

( * ) Notice: Subject to any disclaimer, the term of this patent is extended or adjusted under 35 U.S.C. 154(b) by 406 days.

(21) Appl. No.: 15/491,964

(22) Filed: Apr. 19, 2017

(65) Prior Publication Data

US 2017/0304824 A1 Oct. 26, 2017

(30) Foreign Application Priority Data

Apr. 22, 2016 (TW) ..... 105112542 A
Oct. 27, 2016 (TW) ..... 105134719 A

(51) Int. Cl.
*B03C 5/00* (2006.01)
*B01L 3/00* (2006.01)
*B03C 5/02* (2006.01)

(52) U.S. Cl.
CPC ..... *B01L 3/50273* (2013.01); *B01L 3/502761* (2013.01); *B03C 5/005* (2013.01);
(Continued)

(58) Field of Classification Search
CPC ..... B01L 3/50273; B01L 3/502761; B01L 2400/0424; B01L 2200/0652;
(Continued)

(56) References Cited

U.S. PATENT DOCUMENTS 9,332,236 B2 5/2016 Fujioka
2009/0170186 A1* 7/2009 Wu ..... B03C 5/026 435/286.1

(Continued)

FOREIGN PATENT DOCUMENTS

CN 102449163 A 5/2012
CN 104048906 A 9/2014
TW 200739075 A 10/2007

OTHER PUBLICATIONS

Liang et al., Rapid and Label-Free Separation of Burkitts Lymphoma Cells from Red Blood Cells by Optically-Induced Electrokinetics, pp. 1-9, Mar. 2014, Public Library of Science, http://www.plosone.org/.

(Continued)

*Primary Examiner* — J. Christopher Ball
(74) *Attorney, Agent, or Firm* — CKC & Partners Co., LLC

(57) ABSTRACT

A biological sorting apparatus is disclosed, which includes a light-induced dielectrophoretic chip, a supporting platform, an injecting unit and a projection module. The light-induced dielectrophoretic chip is configured to generate an internal electric field to perform sorting on a fluid including first microparticles and second microparticles. The supporting platform is utilized to support the light-induced dielectrophoretic chip thereon and has an opening. The injecting unit is configured to inject the fluid into the light-induced dielectrophoretic chip. The projection module is disposed below the supporting platform and is configured to project a light pattern onto a projection area of the light-induced dielectrophoretic chip through the opening of the supporting platform, such that the light-induced dielectrophoretic chip (Continued)

produces a light-induced effect to change the internal electric field, thereby sorting out the first microparticles and the second microparticles.

20 Claims, 6 Drawing Sheets

(52) U.S. Cl.
CPC ..... *B03C 5/024* (2013.01); *B03C 5/026* (2013.01); *B01L 2200/0652* (2013.01); *B01L 2300/0887* (2013.01); *B01L 2400/0424* (2013.01); *B03C 2201/26* (2013.01)

(58) Field of Classification Search
CPC . B01L 2300/0887; B03C 5/026; B03C 5/024; B03C 5/005; B03C 2201/26
See application file for complete search history.

(56) References Cited

U.S. PATENT DOCUMENTS

2012/0118740 A1* 5/2012 Garcia ..... B03C 5/005 204/547
2016/0171686 A1* 6/2016 Du ..... G01N 15/1434 382/130

OTHER PUBLICATIONS

Huang et al., High-purity and label-free isolation of circulating tumor cells (CTCs) in a microfluidic platform by using optically-induced-dielectrophoretic (ODEP) force, pp. 1371-1383, 2013, The Royal Society of Chemistry 2013 (https://www.rsc.org/).
Chiu et al., Application of optically-induced-dielectrophoresis in microfluidic system for purification of circulating tumour cells for gene expression analysis—Cancer cell line model, pp. 1-14, Sep. 9, 2016, Nature, https://www.nature.com/srep/.
Wikipedia, Red Blood Cell, pp. 1-13, Dec. 4, 2015, Wikipedia, https://en.wikipedia.org/w/index.php?title=Red_blood_cell&oldid=693657954.
Wikipedia, Cell (biology), pp. 1-13, May 7, 2015, Wikipedia, https://en.wikipedia.org/w/index.php?title=Cell_(biology)&oldid=661317349.

* cited by examiner

BIOLOGICAL SORTING APPARATUS AND METHOD THEREOF

RELATED APPLICATIONS

This application claims priority to Taiwan Patent Application Serial Number 105112542, filed on Apr. 22, 2016, and Taiwan Patent Application Serial Number 105134719, filed on Oct. 27, 2016, which are herein incorporated by reference.

BACKGROUND

Field of the Invention

The invention relates to a biological sorting apparatus and a biological sorting method which uses the biological sorting apparatus for microparticles sorting.

Description of Related Art

Medical examination is a method of performing analyses on microparticles or biological molecules by utilizing various medical analysis instruments and assisting an evaluation of an organism's physical condition based on analyzing results. If only one type of microparticles is to be analyzed, a sorting process needs to be performed on different microparticles in a fluid. If the sorting result of the microparticles is not good, subsequent analyses to the microparticles would be severely affected, which results in analysis accuracy degradation. On the other hand, the conventional biological sorting instruments have high hardware cost, and hours or even tens of hours are required for such conventional biological sorting instruments to perform biological sorting. How to solve the abovementioned drawbacks has now become one of the major tasks in related industries.

SUMMARY OF THE INVENTION

An objective of the invention is to provide a biological sorting apparatus and a biological sorting method using the biological sorting apparatus having at least advantages of high sorting rate, low hardware cost and short time of a sorting process.

One aspect of the invention is directed to a biological sorting apparatus which includes a light-induced dielectrophoretic chip, a supporting platform, an injecting unit and a projection module. The light-induced dielectrophoretic chip is configured to generate an internal electric field to perform sorting on a fluid including first microparticles and second microparticles. The supporting platform is utilized to support the light-induced dielectrophoretic chip thereon and has an opening. The injecting unit is configured to inject the fluid into the light-induced dielectrophoretic chip. The projection module is disposed below the supporting platform and is configured to project a light pattern onto a projection area of the light-induced dielectrophoretic chip through the opening of the supporting platform, such that the light-induced dielectrophoretic chip produces a light-induced effect to change the internal electric field, thereby sorting out the first microparticles and the second microparticles.

In accordance with some embodiments of the invention, a wavelength of the patterned light source projected by the light source module is in a range from 280 nm to 1400 nm.

In accordance with some embodiments of the invention, the light-induced dielectrophoretic chip includes a first electrode layer, a second electrode layer, a semiconductor layer and a channel layer. The second electrode layer is disposed relative to the first electrode layer. The semiconductor layer is disposed on the first electrode layer. The channel layer is disposed between the second electrode layer and the semiconductor layer and defines an injecting region, a first accumulating region and a second accumulating region. The injecting region, the first accumulating region and the second accumulating region intersect in the projection area, the injecting region is configured to guide the fluid into the projection area, and the first accumulating region and the second accumulating region are configured to guide the sorted first microparticles and the sorted second microparticles, respectively.

In accordance with some embodiments of the invention, the second electrode layer includes an inlet interface, a first outlet interface and a second outlet interface. The inlet interface is adjacent to an input terminal of the injecting region, the inlet interface configured to let the fluid flow through the second electrode layer and into the injecting region. The first outlet interface is adjacent to an output terminal of the first accumulating region and is configured to let the first microparticles flow through the second electrode layer and out of the light-induced dielectrophoretic chip from the first accumulating region. The second outlet interface is adjacent to an output terminal of the second accumulating region and is configured to let the second microparticles flow through the second electrode layer and out of the light-induced dielectrophoretic chip from the second accumulating region.

In accordance with some embodiments of the invention, a thickness of the channel layer is substantially in a range from 30 microns to 100 microns.

In accordance with some embodiments of the invention, the thickness of the channel layer is substantially in a range from 40 microns to 60 microns.

In accordance with some embodiments of the invention, the projection module includes a light emitting element and a light modulator. The light emitting element configured to generate light. The light modulator is configured to convert the light into the light pattern.

In accordance with some embodiments of the invention, the light modulator is a digital micromirror device (DMD).

In accordance with some embodiments of the invention, the light modulator is a liquid crystal on silicon (LCoS) device.

In accordance with some embodiments of the invention, the light pattern is programmable.

In accordance with some embodiments of the invention, a size of the projection area is substantially in a range from 1 $mm^2$ to 100 $mm^2$.

In accordance with some embodiments of the invention, the size of the projection area is substantially $1.5 \times 1.5$ $mm^2$.

In accordance with some embodiments of the invention, the biological sorting apparatus further includes a lens module disposed between the light-induced dielectrophoretic chip and the projection module for adjusting a size of the projection area.

In accordance with some embodiments of the invention, the lens module is disposed in the opening of the supporting platform.

In accordance with some embodiments of the invention, the biological sorting apparatus further includes an image detecting module configured to detect a sorting status of the fluid in the light-induced dielectrophoretic chip and to generate an analyzing result accordingly.

In accordance with some embodiments of the invention, the biological sorting apparatus further includes a power supply unit configured to supply power to the light-induced dielectrophoretic chip.

In accordance with some embodiments of the invention, a peak value of the voltage generated by the power supply unit is substantially in a range from 1 Volt to 50 Volts.

In accordance with some embodiments of the invention, a frequency of the voltage generated by the power supply unit is substantially in a range from $10^3$ Hertz to $10^8$ Hertz.

Another aspect of the invention is directed to a biological sorting method used for the biological sorting apparatus and including the following steps. A fluid having first microparticles and second microparticles is injected into the light-induced dielectrophoretic chip by the injecting unit in a speed of 2 mL/min to 200 mL/min. A voltage difference is provided to the light-induced dielectrophoretic chip, such that the light-induced dielectrophoretic chip generates an internal electric field accordingly. The projection module is arranged to project a light pattern onto the projection area of the light-induced dielectrophoretic chip through the opening of the supporting platform to change the internal electric field of the light-induced dielectrophoretic chip, such that the first microparticles and the second microparticles are sorted out by the internal electric field.

In accordance with some embodiments of the invention, the fluid injected into the light-induced dielectrophoretic chip has the first and second microparticles of micron-level.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings.

DETAILED DESCRIPTION OF THE INVENTION

The detailed explanation of the present invention is described as following. The described preferred embodiments are presented for purposes of illustrations and description, and they are not intended to limit the scope of the present invention.

It will be understood that, although the terms "first" and "second" and may be used herein to describe various elements, components, regions, layers and/or sections, these elements, components, regions, layers and/or sections should not be limited by these terms. These terms are only used to distinguish one element, component, region, layer or section from another.

Figure 1:
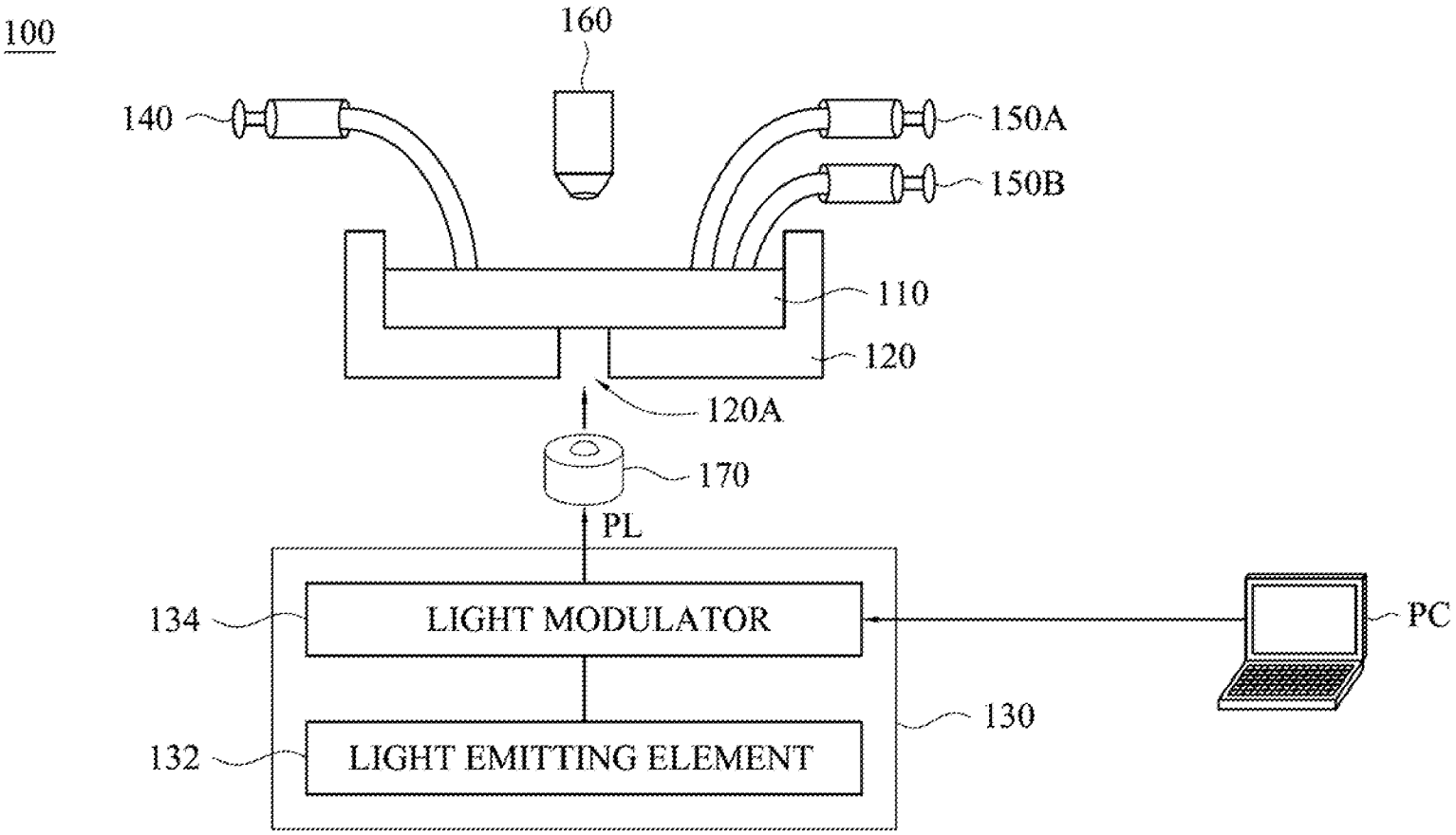
FIG. 1 illustrates a schematic diagram of a biological sorting apparatus in accordance with some embodiments of the invention.

Please refer to FIG. 1, FIG. 1 illustrates a schematic diagram of a biological sorting apparatus 100 in accordance with some embodiments of the invention. The biological sorting apparatus 100 includes a light-induced dielectrophoretic chip 110, a supporting platform 120, a projection module 130, an injecting unit 140, accumulating units 150A and 150B and an image detecting module 160. The light-induced dielectrophoretic chip 110 is configured to perform a sorting process on different microparticles. In this context, the microparticles may be such as biological cells, biological molecules, air particles, waterborne impurities and dielectric powders. In some embodiments, the microparticles to be sorted out are micron-level microparticles. The light-induced dielectrophoretic chip 110 is configured to generate an internal electric field and to use dielectrophoresis force (DEP force) theory to have different microparticles move to different places under different DEP forces. As such, different microparticles can be sorted out by the light-induced dielectrophoretic chip 110.

Figure 2A:
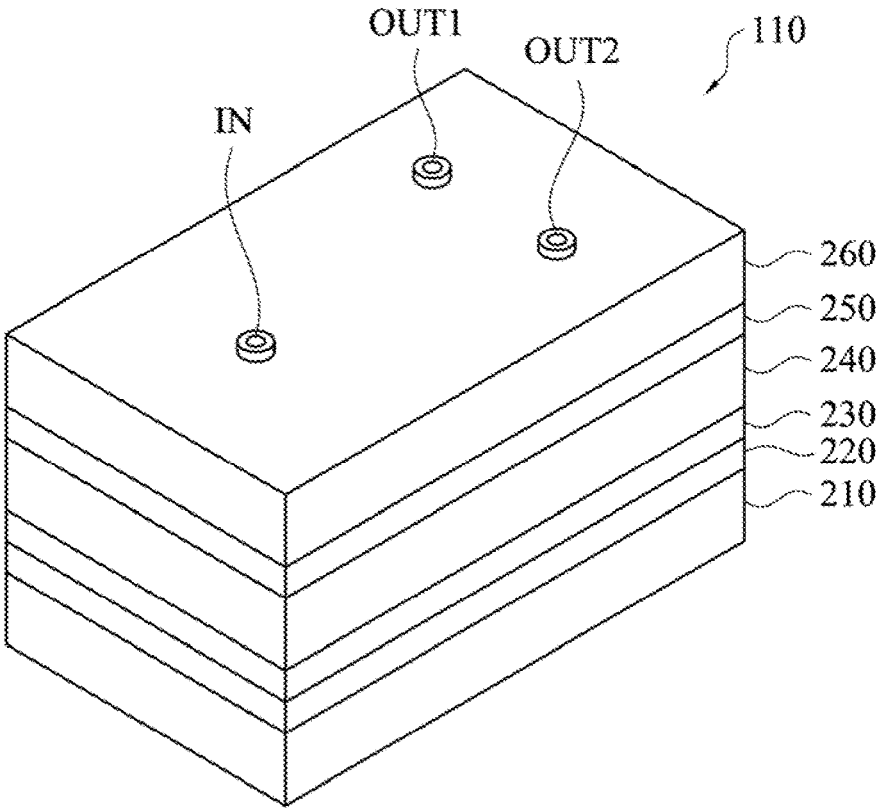
FIG. 2A illustrates a structural diagram of a light-induced dielectrophoretic chip in FIG. 1.

The structure of the light-induced dielectrophoretic chip 110 is shown in FIG. 2A. The light-induced dielectrophoretic chip 110 includes a lower substrate 210, a first electrode layer 220, a semiconductor layer 230, a channel layer 240, a second electrode layer 250 and an upper substrate 260. The lower substrate 210 is an optically transparent substrate, such as a glass substrate or a plastic substrate, but is not limited thereto.

The first electrode layer 220 is disposed on the lower substrate 210, including transparent conductive material, such as indium tin oxide (ITO), indium zinc oxide (IZO) or another similar conductive material.

The semiconductor layer 230 is disposed on the first electrode layer 220, and may include indirect bandgap material, such as silicon, germanium or another similar material. The semiconductor layer 230 may be formed of amorphous silicon, monocrystalline silicon, nanocrystalline silicon, polycrystalline silicon or a combination thereof.

Figure 2B:
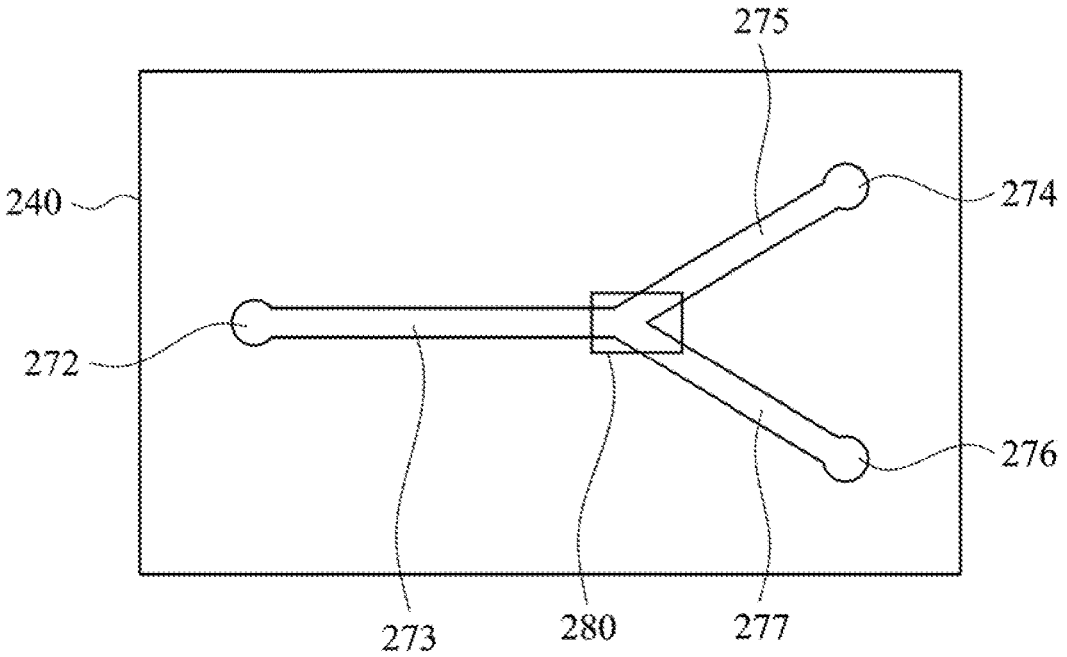
FIG. 2B illustrates a planar view of the channel layer of FIG. 2A.

The channel layer 240 is disposed on the semiconductor layer 230. Please also refer to FIG. 2B, FIG. 2B illustrates a planar view of the channel layer 240. As shown in FIG. 2, the channel layer 240 defines an inlet interface 272, an injecting region 273, a first outlet interface 274, a first accumulating region 275, a second outlet interface 276 and a second accumulating region 277, where the injecting region 273, the first accumulating region 275 and the second accumulating region 277 intersect in a projection area 280. The fluid is injected into the channel layer 240 through the inlet interface 272. The injecting region 273 is configured to guide the fluid to the projection area 280. If the projection area 280 is under illumination by the light pattern, the internal electric field between the first electrode layer 220 and the second electrode layer 250 correspondingly changes, such that the first microparticles and the second microparticles of the fluid move in different directions, and then the first accumulating region 275 may guide the first microparticles to flow to outside of the light-induced dielectrophoretic chip 110 through the first outlet interface 274, and the second accumulating region 277 may guide the second microparticles to flow to outside of the light-induced dielectrophoretic chip 110 through the second outlet interface 276.

The second electrode layer 250 is disposed on the channel layer 240. In some embodiments, the second electrode layer 250 includes transparent conductive material, such as ITO, IZO or another similar conductive material. In this embodiment, the first electrode layer 220 and the second electrode layer 250 are electrically connected to an external power supply AC which provides a voltage difference to the first electrode layer 220 and the second electrode layer 250, such that an internal electric field is generated between the first electrode layer 220 and the second electrode layer 250.

The upper substrate 260 is disposed on the second electrode layer 250. The upper substrate 260 is an optically transparent substrate, such as a glass substrate or a plastic substrate, but is not limited thereto. In addition, an inlet interface IN and outlet interfaces OUT1 and OUT2 are disposed on the upper substrate 260. The inlet interface IN is configured to provide a path for the fluid to flow into the inlet interface 272, the outlet interface OUT1 is configured to provide a path for the first microparticles to flow to out of the light-induced dielectrophoretic chip 110 from the first outlet interface 274, and the outlet interface OUT2 is configured to provide a path for the second microparticles to flow to out of the light-induced dielectrophoretic chip 110 from the second outlet interface 276.

In some embodiments, the thicknesses of the lower substrate 210 and the upper substrate 260 are about 0.7 mm, the thicknesses of the first electrode layer 220 and the second electrode layer 250 are in a range from about 50 nm to about 500 nm, the thickness of the semiconductor layer 230 is in a range from about 1 micron to about 2 microns, and the thickness of the channel layer 240 is in a range from about 30 microns to about 100 microns. In certain embodiments, the thickness of the channel layer 240 is in a range from about 40 microns to about 60 microns. In addition, in some embodiments, the angle between the injecting region 273 and the first accumulating region 275 is about 169 degrees, the angle between the first accumulating region 275 and the second accumulating region 277 is about 22 degrees, the injecting region 273, the widths of the first accumulating region 275 and the second accumulating region 277 are in a range from about 0.8 mm to about 20 mm, and the calibers of the inlet interface 272, the first outlet interface 274 and the second outlet interface 276 are about 1.1 mm. In some embodiments, the size of the projection area 280 is in a range from about 1 $mm^2$ to about 100 $mm^2$. In certain embodiments, the size of the projection area 280 is about 1.5×1.5 $mm^2$. The values (such as thicknesses, widths and/or angles) of each portion of the light-induced dielectrophoretic chip 110 may be adjusted according to practical requirements, but are not limited to the aforementioned values.

Referring back to FIG. 1, the supporting platform 120 is utilized to support the light-induced dielectrophoretic chip 110 thereon. The supporting platform 120 has an opening 120A, such that light can project onto the light-induced dielectrophoretic chip 110 through the opening 120A. Further, in some embodiments, the supporting platform 120 includes an accommodating structure for accommodating and mounting the light-induced dielectrophoretic chip 110. Such accommodating structure may be a ring-shaped protruding structure, a rectangular-shaped recessing structure, or any other structure suitable for fixing the light-induced dielectrophoretic chip 110.

The projection module 130 is configured to generate a light pattern and to project the light pattern onto the light-induced dielectrophoretic chip 110 through the opening 120A of the supporting platform 120. The luminous exitance and the wavelength of the generated light pattern of the projection module 130 may be between $9\times10^4$ lux and $1.2\times10^5$ lux and between 280 nm and 1400 nm, respectively. In some embodiments, the wavelength of the generated light pattern is in a range from 300 nm to 380 nm, from 480 nm to 550 nm or from 700 nm to 900 nm.

The projection module 130 includes a light emitting element 132 and a light modulator 134. The light emitting element 132 is configured to generate light, which can be a lamp, an LED or a laser, but is not limited thereto. For example, the light emitting element 132 may be an LED which is used for emitting light including components in a wavelength range visible light. The light modulator 134 is configured to convert the light generated by the light emitting element 132 into a light pattern and to project the light pattern onto a projected area 280 shown in FIG. 2B. In some embodiments, the size of the projected area 280 is about 1.5×1.5 $mm^2$. In some embodiments, the light modulator 134 is a digital micromirror device (DMD) or a liquid crystal on silicon (LCoS) device used for receiving the light emitted by the light emitting element 132 and converting the light into a light pattern based on mage data. In some embodiments, the light modulator 134 may change the light pattern based on a direction of a computer device, i.e., the light pattern of the light modulator 134 is programmable.

The projection module 130 may communicatively connect with a computer device PC for receiving image data from the computer device PC and determining the light pattern to be outputted based on the received image data. Particularly, the projection module 130 may communicatively connect with a computer device PC by a wired communication method (such as VGA, HDMI, eDP and USB) or a wireless communication method (such as Wi-Fi and Bluetooth); after the communication between the projection module 130 and the computer device PC is established, the computer device PC transmits image data to the projection module 130, and then the light emitted by the light emitting element 132 is converted into a light pattern by the process of the light modulator 134 based on the image data. The projection module 130 may further include an element such as a lens and/or a reflector for adjusting the focus and/or the planar range of the light pattern.

The injecting unit 140 is connected to the inlet interface IN of the light-induced dielectrophoretic chip 110 for injecting a fluid including first microparticles and second microparticles into the light-induced dielectrophoretic chip 110. The injecting unit 140 may include a pump or another element which can control the injection speed of the fluid into the light-induced dielectrophoretic chip 110. In some embodiments, the injecting unit 140 injects the fluid into the light-induced dielectrophoretic chip 110 in a speed of 2 mL/min to 200 mL/min. The accumulating units 150A and 150B are respectively connected to the output interfaces OUT1 and OUT2 of the light-induced dielectrophoretic chip 110 for respectively accumulating the first and second microparticles flowing out from the light-induced dielectrophoretic chip 110.

The image detecting module 160 is disposed above the light-induced dielectrophoretic chip 110, and may be provided for a user to measure the sorting status in the light-induced dielectrophoretic chip 110. In some embodiments, the image detecting module 160 includes an image processing unit, which may perform an image analyzing process on a captured image of the sorting status and generate a analyzing result accordingly, and may real-time adjusting parameters of the biological sorting apparatus 100 (such as the planar projection image, the magnitude and/or the wavelength of the light pattern generated by the projection module 130, the distance between the light-induced dielectrophoretic chip 110 and the projection module 130, the size of the projection area 280 and the injecting speed of the injecting unit 140) according to the analyzing result. In other embodiments, the image detecting module 160 may be coupled to an entity which has image analyzing functionality, and the abovementioned image analyzing process may be performed in such entity.

Further, the biological sorting apparatus 100 may include a lens module 170 which is disposed between the light-induced dielectrophoretic chip 110 and the projection module 130 for adjusting the size of the projection area 280 of the light-induced dielectrophoretic chip 110. The magnification of the lens module 170 may be determined according to the architecture of the biological sorting apparatus 100, such as the distance between the light-induced dielectrophoretic chip 110 and the projection module 130, the structure of the channel layer 240 of the light-induced dielectrophoretic chip 110 and/or the luminous exitance of the projection module 130. The lens module 170 may be disposed in the opening 120A of the supporting platform 120, between the light-induced dielectrophoretic chip 110 and the opening 120A, or between the opening 120A and the projection module 130.

Figure 3A:
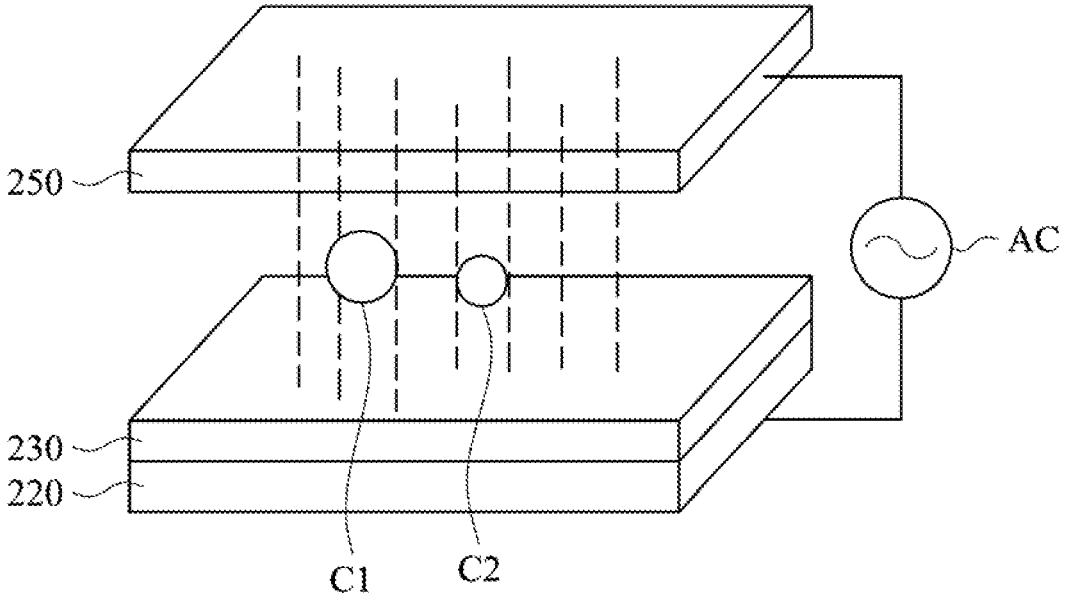
FIG. 3A is a cross-sectional view showing an electric field distribution in the light-induced dielectrophoretic chip in FIG. 2A unilluminated by a light pattern.
Figure 3B:
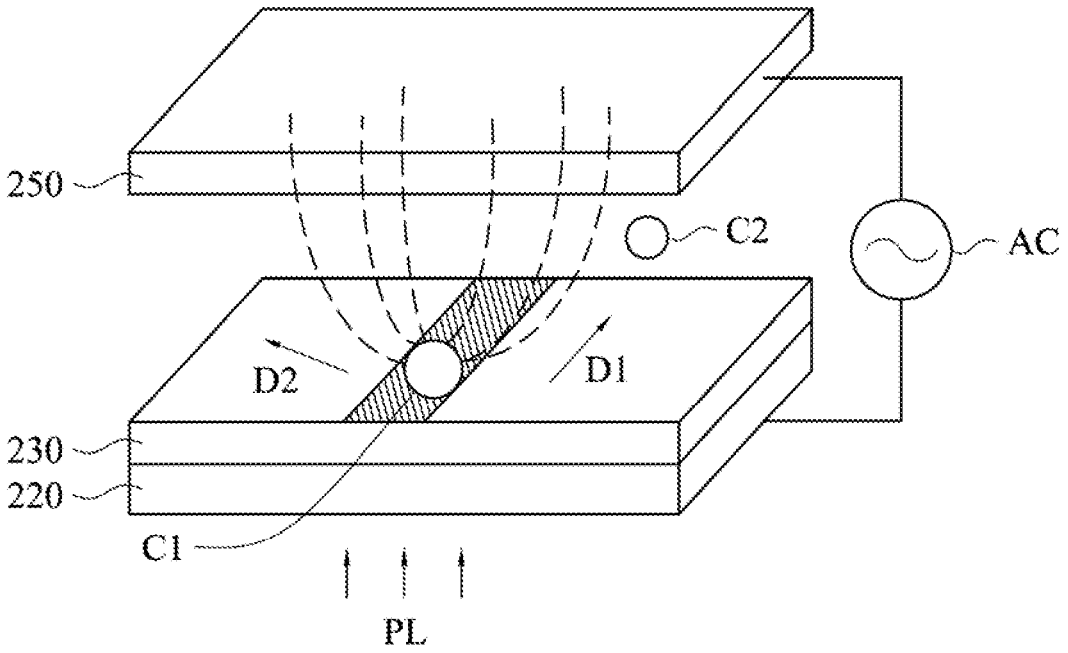
FIG. 3B is a cross-sectional view showing an electric field distribution in the light-induced dielectrophoretic chip in FIG. 2A illuminated by a light pattern.

FIG. 3A and FIG. 3B illustrate cross-sectional views respectively showing an electric field distribution in the light-induced dielectrophoretic chip 110 non-illuminated and illuminated by a light pattern. As shown in FIG. 3A, when the light-induced dielectrophoretic chip 110 is not illuminated by a light pattern and the first electrode layer 220 and the second electrode layer 250 are electrically connected to the two terminals of the power supply unit AC, respectively, the electric field between the first electrode layer 220 and the second electrode layer 250 is uniform, and thus the microparticles C1 and C2 do not move to particular directions under an effect of a non-uniform electric field at this time. The peak value and the frequency of the voltage generated by the power supply unit AC may be 1 Volt to 50 Volts and $10^3$ Hertz to $10^8$ Hertz, respectively, and preferably 15 Volts to 25 Volts and 10 Hertz to $10^6$ Hertz, respectively. As shown in FIG. 3B, when illuminated by a light pattern, the light-induced dielectrophoretic chip 110 produces an light-induced effect to change the electric field distribution between the first electrode layer 220 and the second electrode layer 250, such that the microparticles C1 move to the illuminated area of the light pattern by a positive DEP force D1 and the microparticles C2 move to out of the illuminated area of the light pattern by a negative DEP force D2.

Figure 4A:
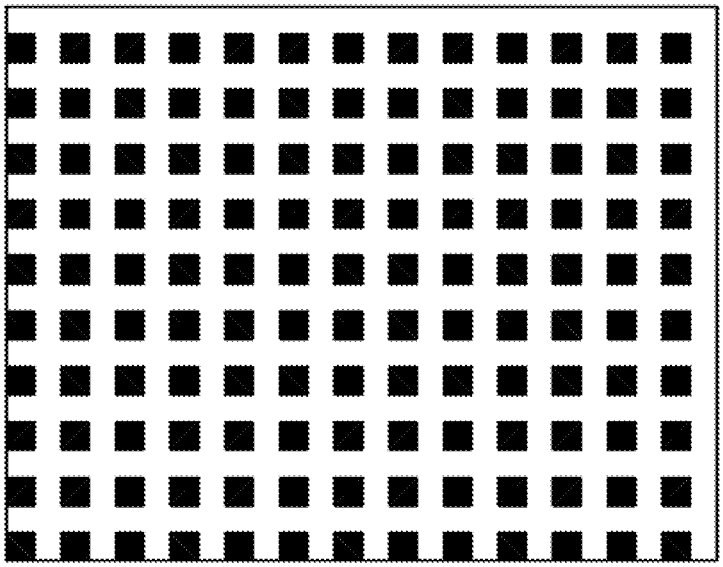
FIG. 4A to FIG. 4C exemplarily show planar projection images of light patterns projected by the projection module of FIG. 1.
Figure 4B:
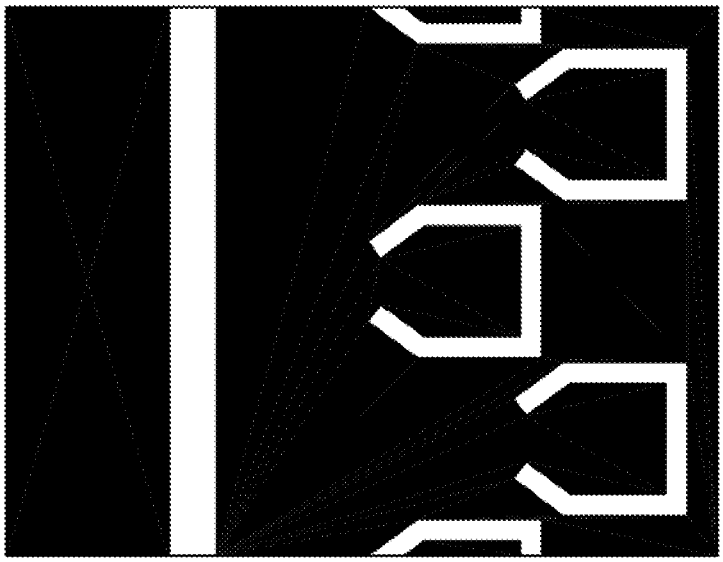
Figure 4C:
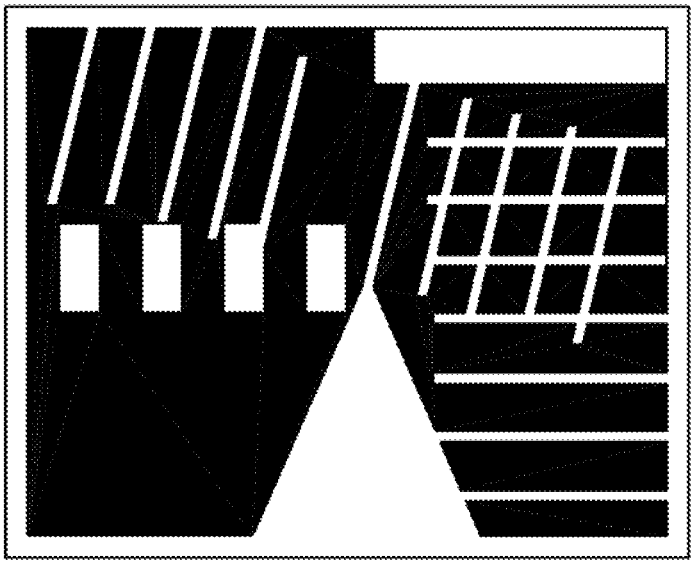

FIG. 4A to FIG. 4C exemplarily show planar projection images of light patterns projected to the projection area 280 by the projection module 130. The planar projection images of FIG. 4A to FIG. 4C are a mash light pattern, a dielectrophoretic trapper light pattern and an induced light pattern, respectively. It is note that the planar projection images shown in FIG. 4A to FIG. 4C are merely for illustrative purposes. In practical operations, the projection module 130 may be controlled according to various operational factors to project a corresponding light pattern to the projected area 280, and the planar projection image projected on the projected area 280 is not limited to those shown in FIG. 4A to FIG. 4C.

Figure 5:
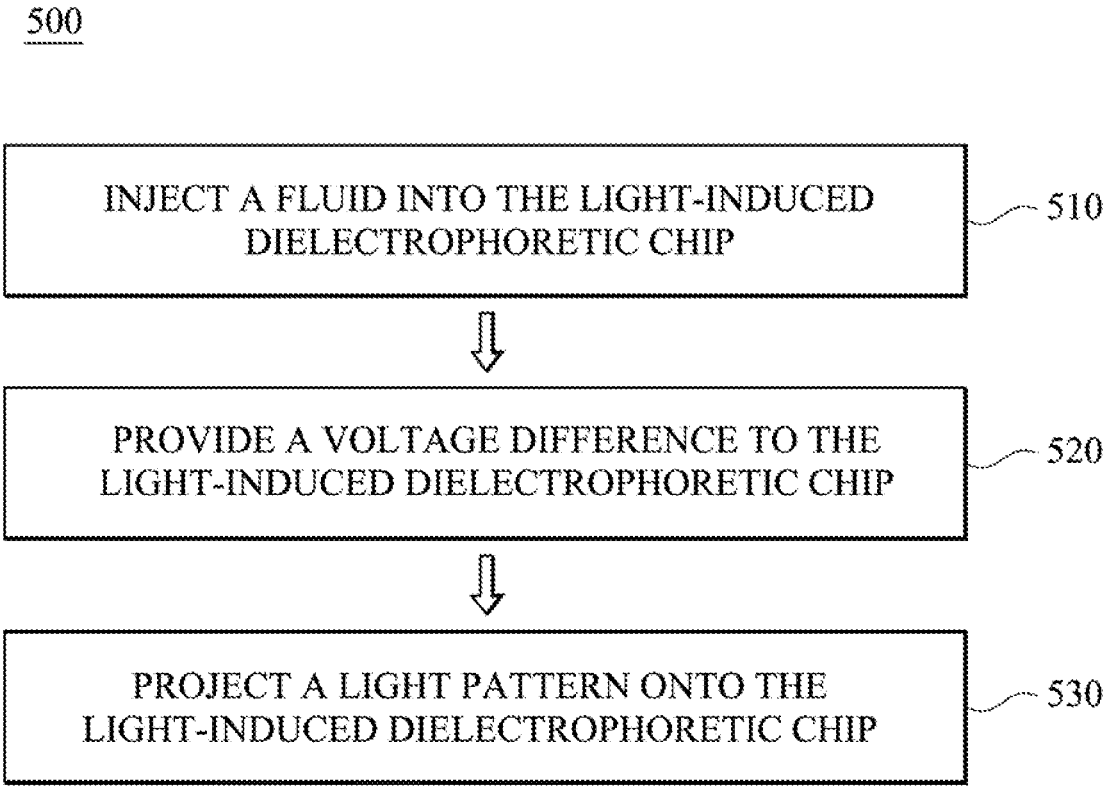
FIG. 5 is a flowchart diagram of a biological sorting method performed by the biological sorting apparatus of FIG. 1.

Please refer to FIG. 5, FIG. 5 is a flowchart diagram of a biological sorting method 500 performed by the biological sorting apparatus 100. The biological sorting method 500 includes the following steps. At first, a step 510 is performed, in which a fluid with microparticles C1 and C2 is injected into the injecting region 273 by the injecting unit 140 in a speed of 2 ml/min to 200 mL/min. Then, a step 520 is performed, in which a voltage difference is provided to the first electrode layer 220 and the second electrode layer 250 of the light-induced dielectrophoretic chip 110, so as to generate an internal electric field between the first electrode layer 220 and the second electrode layer 250. Next, a step 530 is performed, in which the projection module is arranged to generate a light pattern and to project the light pattern onto the projection area 280 of the light-induced dielectrophoretic chip 110. The internal electric field between the first electrode layer 220 and the second electrode layer 250 changes from uniform to non-uniform under the projection of the light pattern, such that the first microparticles C1 flow from the injecting region 273 into the first accumulating region 275 and the second microparticles C2 flow from the injecting region 273 into the second accumulating region 277 in an electrically driving manner. By the foregoing biological sorting method 500, the microparticles C1 and C2 can respectively be accumulated from the outlet interfaces OUT1 and OUT2.

Figure 6A:
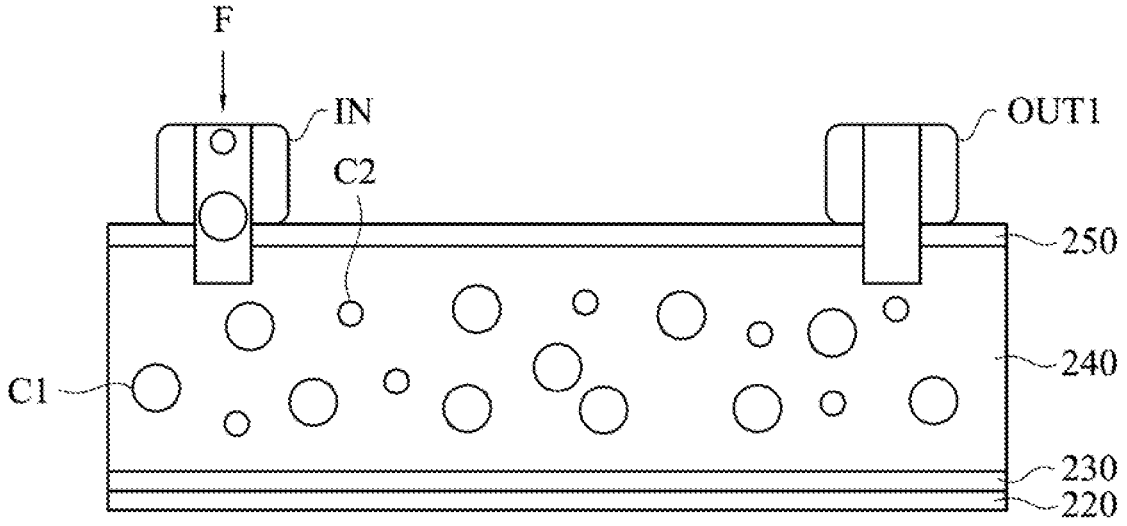
FIG. 6A is a cross-sectional view showing a distribution of the microparticles in the light-induced dielectrophoretic chip of FIG. 2A unilluminated by a light pattern.
Figure 6B:
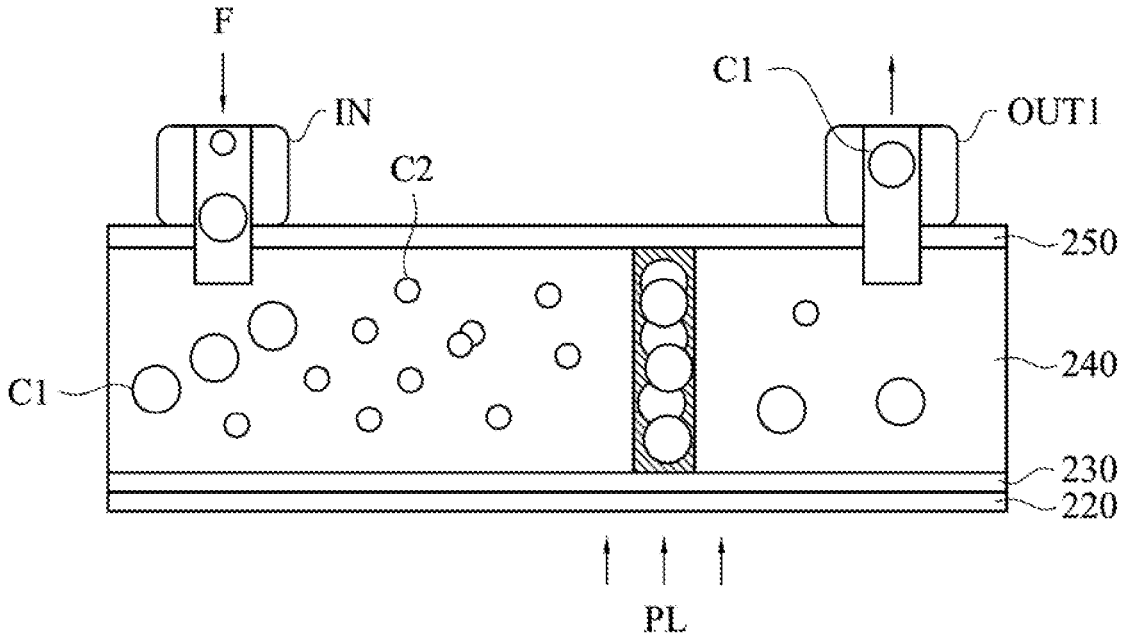
FIG. 6B is a cross-sectional view showing a distribution of microparticles in the light-induced dielectrophoretic chip of FIG. 2A illuminated by a light pattern.

In the following, a sorting process to leukocyte cells and cancer cells (including colorectal cancer cells, lung cancer cells and breast cancer cells) is exemplified for description. FIG. 6A. corresponds to the step 510 of the biological sorting method 500, and FIG. 6B corresponds to the steps 520 and 530 of the biological sorting method 500, where FIG. 6A is a cross-sectional view showing a distribution of the microparticles in the light-induced dielectrophoretic chip 110 unilluminated by a light pattern, and FIG. 6B is a cross-sectional view showing a distribution of the microparticles in the light-induced dielectrophoretic chip 110 illuminated by light pattern. For convenient description, the lower substrate 210, the upper substrate 260 and the channel layer 240 are not shown in FIG. 6A and FIG. 6B. At first, a fluid including cancer cells (e.g. microparticles C1) and leukocyte cells (e.g. microparticles C2) is injected into the channel layer 240. When the light-induced dielectrophoretic chip 110 is not illuminated by a light pattern, as shown in FIG. 6A, the cancer cells and the leukocyte cells are uniformly distributed in the channel layer 240. When a light pattern is projected onto the light-induced dielectrophoretic chip 110, as shown in FIG. 6B, the electric field at the illuminated area of the light pattern is stronger, such that the cancer cells move to the projection area of the light pattern by a positive DEP force, and the leukocyte cells move to out of the illuminated area by a negative DEP force. With the non-uniform electric field generated by the projection of the light pattern, the leukocyte cells gradually approach the outlet interface OUT1 by electrical driving OUT1 and finally flow to outside of light-induced dielectrophoretic chip 110 through the outlet interface OUT1.

By using the biological sorting apparatus and the biological sorting method of the invention, the purity of the sorted microparticles can be up to higher than 85% (i.e. achieving high purity). In addition, in comparison with the conventional biological sorting instruments, the biological sorting apparatus of the invention has advantages of low hardware cost and sorting out microparticles with high purity in a shorter time. Therefore, the biological sorting apparatus of the invention is suitable for biological and medical applications, such as biochemical treatment and laboratory medicine.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims.

What is claimed is:

1. A biological sorting apparatus, comprising:

a light-induced dielectrophoretic chip configured to generate an internal electric field to perform sorting on a fluid including first microparticles and second microparticles;

a supporting platform utilized to support the light-induced dielectrophoretic chip thereon, the supporting platform having an opening;

a fluid injector configured to inject the fluid into the light-induced dielectrophoretic chip;

a projector disposed below the supporting platform, the projector configured to project a light pattern onto a projection area of the light-induced dielectrophoretic chip through the opening of the supporting platform, such that the light-induced dielectrophoretic chip produces a light-induced effect to change the internal electric field, thereby sorting out the first microparticles and the second microparticles; and an image detector configured to detect a sorting status of the fluid in the light-induced dielectrophoretic chip to generate an analyzing result accordingly, and configured to real-time adjust a planar projection image, a magnitude and a wavelength of the light pattern generated by the projector, a distance between the light-induced dielectrophoretic chip and the projection module, a size of the projection area and an injecting speed of the fluid injector depending on the analyzing result.

2. The biological sorting apparatus of claim 1, wherein a wavelength of the light pattern projected by the projector is in a range from 280 nm to 1400 nm.

3. The biological sorting apparatus of claim 1, wherein the light-induced dielectrophoretic chip comprises:

a first electrode layer;

a second electrode layer disposed relative to the first electrode layer;

a semiconductor layer disposed on the first electrode layer; and a channel layer disposed between the second electrode layer and the semiconductor layer, the channel layer defining an injecting region, a first accumulating region and a second accumulating region, wherein the injecting region, the first accumulating region and the second accumulating region intersect in the projection area, the injecting region is configured to guide the fluid into the projection area, and the first accumulating region and the second accumulating region are configured to guide the sorted first microparticles and the sorted second microparticles, respectively.

4. The biological sorting apparatus of claim 3, wherein the second electrode layer comprises:

an inlet interface adjacent to an input terminal of the injecting region, the inlet interface configured to let the fluid flow through the second electrode layer and into the injecting region;

a first outlet interface adjacent to an output terminal of the first accumulating region, the first outlet interface configured to let the first microparticles flow through the second electrode layer and out of the light-induced dielectrophoretic chip from the first accumulating region; and a second outlet interface adjacent to an output terminal of the second accumulating region, the second outlet interface configured to let the second microparticles flow through the second electrode layer and out of the light-induced dielectrophoretic chip from the second accumulating region.

5. The biological sorting apparatus of claim 3, wherein a thickness of the channel layer is substantially in a range from 30 microns to 100 microns.

6. The biological sorting apparatus of claim 5, wherein the thickness of the channel layer is substantially in a range from 40 microns to 60 microns.

7. The biological sorting apparatus of claim 1, wherein the projector comprises:

a light emitter configured to generate light; and a optical modulator configured to convert the light into the light pattern.

8. The biological sorting apparatus of claim 7, wherein the optical modulator is a digital micromirror device (DMD).

9. The biological sorting apparatus of claim 7, wherein the optical modulator is a liquid crystal on silicon (LCoS) device.

10. The biological sorting apparatus of claim 1, wherein the light pattern is programmable.

11. The biological sorting apparatus of claim 1, wherein a size of the projection area is substantially in a range from 1 $mm^2$ to 100 $mm^2$.

12. The biological sorting apparatus of claim 11, wherein the size of the projection area is substantially $1.5\times1.5$ $mm^2$.

13. The biological sorting apparatus of claim 1, further comprising:

a lens module disposed between the light-induced dielectrophoretic chip and the projector for adjusting a size of the projection area.

14. The biological sorting apparatus of claim 13, wherein the lens module is disposed in the opening of the supporting platform.

15. The biological sorting apparatus of claim 1, further comprising:

a power supply unit configured to supply power to the light-induced dielectrophoretic chip.

16. The biological sorting apparatus of claim 15, wherein a peak value of the voltage generated by the power supply unit is substantially in a range from 1 Volt to 50 Volts.

17. The biological sorting apparatus of claim 15, wherein a frequency of the voltage generated by the power supply unit is substantially in a range from $10^3$ Hertz to $10^8$ Hertz.

18. A biological sorting method used for a biological sorting apparatus having a light-induced dielectrophoretic chip, a projector and an image detector, the biological sorting method comprising:

injecting a fluid having first microparticles and second microparticles into the light-induced dielectrophoretic chip in a speed of 2 mL/min to 200 mL/min;

providing a voltage difference to the light-induced dielectrophoretic chip, such that the light-induced dielectrophoretic chip generates an internal electric field accordingly;

arranging the projector to project a light pattern onto a projection area of the light-induced dielectrophoretic chip to change the internal electric field of the light-induced dielectrophoretic chip, such that the first microparticles and the second microparticles are sorted out by the internal electric field;

detecting a sorting status of the fluid in the light-induced dielectrophoretic chip by the image detector to generate an analyzing result accordingly; and real-time adjusting a planar projection image, a magnitude and a wavelength of the light pattern generated by the projector, a distance between the light-induced dielectrophoretic chip and the projection module, a size of the projection area and the speed of the fluid injected into the light-induced dielectrophoretic chip depending on the analyzing result.

19. The biological sorting method of claim 18, wherein the fluid injected into the light-induced dielectrophoretic chip has the first and second microparticles of micron-level.

20. The biological sorting method of claim 18, wherein the first microparticles are cancer cells, and the second microparticles are leukocyte cells.

* * * * *